United States Patent [19]

Hosoi et al.

[11] 4,418,942

[45] Dec. 6, 1983

[54] MICROCAPSULE SHEET FOR PRESSURE-SENSITIVE RECORDING PAPER

[75] Inventors: Noriyuki Hosoi; Yoshiyuki Hoshi; Hiroharu Matsukawa, all of Fujinomiya, Japan

[73] Assignee: Fuji Photo Film Co., Ltd., Kanagawa, Japan

[21] Appl. No.: 335,487

[22] Filed: Dec. 29, 1981

[30] Foreign Application Priority Data

Dec. 29, 1980 [JP] Japan ..... 55-185667

[51] Int. Cl.[3] ..... B41M 5/22

[52] U.S. Cl. ..... 282/27.5; 427/150; 427/151; 428/320.6; 428/323; 428/342; 428/537

[58] Field of Search ..... 282/27.5; 427/150, 151; 428/320.6, 323, 327, 332, 338, 339, 341, 342, 537, 914, 326, 328-331, 402

[56] References Cited

U.S. PATENT DOCUMENTS 4,165,398 8/1979 Raine et al. ..... 428/914

4,269,893 5/1981 Kato et al. ..... 282/27.5

*Primary Examiner*—Bruce H. Hess

*Attorney, Agent, or Firm*—Sughrue, Mion, Zinn, Macpeak and Seas

[57] ABSTRACT

A microcapsule sheet is disclosed. At least one surface of the base paper has a coating produced from a solution that contains microcapsules each containing an electron donating color former, a binder whose solid content is from 20 to 50 parts by weight based on 100 parts by weight of the solid content of the microcapsules, a protective agent and a surfactant having a hydrophobic atomic group of the formula:

$$\begin{array}{l} R_1\text{—OOC—CH—} \\ \qquad\qquad\quad | \\ R_2\text{—OOC—CH}_2 \end{array}$$

wherein $R_1$ and $R_2$ are each an aliphatic hydrocarbon having 2 to 20 carbon atoms or aromatic hydrocarbon having 6 to 20 carbon atoms.

15 Claims, No Drawings

MICROCAPSULE SHEET FOR PRESSURE-SENSITIVE RECORDING PAPER

FIELD OF THE INVENTION

The present invention relates to a microcapsule sheet for pressure-sensitive recording paper having formed thereon microcapsules each containing a substantially colorless electron donating color former that is contacted by an acidic material (color developer) to form a color.

BACKGROUND OF THE INVENTION

Pressure-sensitive recording paper is a recording medium that uses the color forming mechanism due to the transfer of electrons between an electron donating color former and an inorganic or organic acid. The paper generally consists of an upper leaf having microcapsules formed on one surface of a base, a lower leaf having a coating of color developer formed on one surface of a base, and an intermediate leaf having microcapsules formed on one surface of a base and a coating of color developer on the other surface (the upper and intermediate leaves are hereunder collectively referred to as microcapsule sheets). The above-described pressure-sensitive recording papers are well known, for example, as described in U.S. Pat. Nos. 2,505,470; 2,505,489; 2,550,471; 2,548,366 and 2,712,507. To reduce the cost of producing the pressure-sensitive recording paper, it is desired that coatings of microcapsules and color developer be formed on a base at maximum speed. However, as the web handling speed is increased, more air is entrapped by the web being rolled, and the resulting roll has wrinkles similar to the twisted pattern of a rope. This tendency is conspicuous when the web handling speed is greater than 300 m/min.

SUMMARY OF THE INVENTION

One object of the present invention is to provide a microcapsule sheet for pressure-sensitive recording paper that is adapted for high-speed production.

This object of the present invention is achieved by applying to at least one surface of base paper a solution that contains microcapsules each containing an electron donating color former, a binder whose solid content is 20 to 50 parts by weight based on 100 parts by weight of the solid content of the microcapsules, a protective agent and a surfactant having a hydrophobic atomic group of the formula:

$$\begin{array}{l} R_1-OOC-CH- \\ \qquad\qquad\quad | \\ R_2-OOC-CH_2 \end{array}$$

(wherein $R_1$ and $R_2$ are each an aliphatic hydrocarbon having 2 to 20 carbon atoms or aromatic hydrocarbon having 6 to 20 carbon atoms).

DETAILED DESCRIPTION OF THE INVENTION

The term "solid" as applied to the microcapsules means oil globules which are the core of the microcapsule and which have a color former dissolved therein, the color former and the wall of the microcapsule.

The binder coated on the base together with microcapsules has 20 to 50 parts by weight of solid content for 100 parts by weight of the solid content of the microcapsule. If the solid content of the binder is less than 20 parts by weight, unevenness of color appears in spots on the web being rolled at high speed, and the roll of coated pressure-sensitive recording paper fouls when it is slit or cut into a form adapted for practical applications. If the solid content exceeds 50 parts by weight, only a low color density is achieved by the resulting pressure-sensitive recording paper that is used in combination with a lower leaf having a coating of color developer formed on one surface of a base. Furthermore, if a plurality of the microcapsule sheets are used as intermediate leaves that are placed alternately on plain paper sheets, a clear copy is obtained on the first two or three sheets but only a fuzzy copy is obtained on the lower sheets. However, a microcapsule solution containing only the binder having 20 to 50 parts by weight of solid content provides a coating having high gas permeability and cannot be applied onto a base at a web handling speed of 300 m/min or more without causing wrinkles in the paper roll (the wrinkles are hereunder referred to as roll wrinkles).

To produce a microcapsule sheet having low gas permeability and which is adapted to high-speed production, the microcapsule solution must contain a surfactant having a hydrophobic atomic group of the formula:

$$\begin{array}{l} R_1-OOC-CH- \\ \qquad\qquad\quad | \\ R_2-OOC-CH_2 \end{array}$$

(wherein $R_1$ and $R_2$ are each an aliphatic hydrocarbon having 2 to 20 carbon atoms, or aromatic hydrocarbon having 6 to 20 carbon atoms). The microcapsule solution containing such surfactant as well as the binder can be applied onto a base at high speed without fouling the base and it provides a microcapsule sheet for pressure-sensitive recording paper that is subject to minimum fouling during the subsequent slitting or cutting and which gives high color density.

Surfactants having a surface tension of 45 dyne/cm or more at a critical micelle concentration (CMC) such as naphthalenesulfonic acid formalin condensate, alkyl betaines, alkyl imidazolines and alkyl picolinium salts, provide coated paper that has high gas permeability and which hence does not achieve the object of the present invention. A common surfactant such as alkylbenzenesulfonate salt gives a capsule solution having a surface tension as low as that the surfactants specified herein, but perhaps due to the difference in the property to wet the paper, the solution forms a coating whose gas permeability is still high and which cannot be applied to the base at fast speed without causing roll wrinkles. For the purpose of the present invention, the microcapsule solution should form a coating having a gas permeability of not more than 1,000 seconds, preferably not more than 500 seconds.

The essential requirements of the present invention are described below. A base paper sheet on which the microcapsule solution is applied preferably has a gas permeability of not more than 90 seconds. If the gas permeability is greater than 120 seconds, a coated sheet having surface streaks often results. There is no particular limitation on the proportion of soft wood (N) pulp and hard wood (L) pulp in the base paper, the content of filler clay, the nature of the size (whether it is neutral or acidic) or the type of the surface size. One example is ordinary paper 45 to 60μ thick and which has an L/N ratio of 1:1, a filler clay with a talc content of 5 vol%, a neutral size made of long-chain dibasic acid tetrahydrate, and a surface size made of starch. The surface size may be used together with a basic inorganic pigment or a color developer.

The color former-containing microcapsule for use in the present invention can be prepared by various methods: phase separation from aqueous solutions as described in U.S. Pat. Nos. 2,800,457 and 2,800,458; interfacial polymerization as described in Japanese Patent Publication Nos. 19574/63, 446/67, 771/67, 2882/67, 2883/67, 8693/67, 9654/67, 11344/67, Japanese Patent Application (OPI) No. 9097/76 (the term "OPI" as used herein refers to a "published unexamined Japanese patent application"), U.S. Pat. No. 3,287,154, and British Pat. Nos. 950,443 and 1,046,409; polymerization of a microcapsule wall in oil globules as taught in Japanese Patent Publication Nos. 9168/61 and 45133/74; cooling of molten dispersion as described in British Pat. Nos. 952,807 and 965,074; crystallization of polymer as taught in U.S. Pat. Nos. 3,418,250; 3,660,304 and Japanese Patent Publication No. 23165/72; and polymerization of reactants from within oil globules as described in U.S. Pat. Nos. 3,726,804 and 3,796,669.

A urethane resin, amino resin, epoxy resin, amide resin or mixtures thereof are preferably used as an agent to form the wall of the microcapsules used in the present invention. These resins are effective for providing a dense wall. If the resulting microcapsule wall is not adequately dense, the color density is decreased with time or during storage in a hot and humid atmosphere perhaps due to the reaction with the surfactant. For details of the microencapsulation with urethane resins, see Japanese Patent Publication Nos. 446/67, 11344/67, 45133/74 and 22507/75; for the microencapsulation with amino resins, see Japanese Patent Publication Nos. 12380/62, 12518/63, 771/67, 2883/67, 30282/71, Japanese Patent Application (OPI) Nos. 42380/72, 99969/74, 8780/75, 144383/76, 66878/77, U.S. Pat. Nos. 3,993,831 and 4,001,140; for the microcapsulation with epoxy resins, see Japanese Patent Publication Nos. 19574/63, 24420/63 and 27257/69; for the microencapsulation with amide resins, see British Pat. No. 950,443, U.S. Pat. Nos. 3,270,100; 3,429,827; 3,208,951 and British Pat. No. 1,142,649.

The surfactant used in the present invention has a hydrophobic atomic group of the formula:

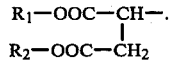

$$\begin{array}{l} R_1-OOC-CH- \\ \qquad\qquad\quad | \\ R_2-OOC-CH_2 \end{array}$$

As $R_1$ and $R_2$ have more carbon atoms, the effect of the surfactant is increased, but then if more than 20 carbon atoms are present, the water solubility of the surfactant is decreased to such a level that its use is practically impossible. If $R_1$ and $R_2$ have less than 2 carbon atoms, the surfactant hardly exhibits its effect. The surfactant has hydrophilic atomic groups such as sulfonate salt, carboxylate salt, phosphate salt, amine salt, quaternary ammonium salt and pyridinium salt. A sulfonate salt having higher water solubility is particularly preferred. Specific examples of the surfactant used in the present invention include di-1-dimethyl-3-methylpentylsulfosuccinate ester, dihexylsulfosuccinate ester, di-1-dimethyl-heptylsulfosuccinate ester, di-benzylsulfosuccinate ester, tetramethyl-dodecylsulfosuccinate ester, tetramethyldecylsulfosuccinate ester, dioctylsulfosuccinate ester, di-2-ethylhexylsulfosuccinate ester, di-isohexylsulfosuccinate ester, and tetramethyl-2-methyl-7-ethyldodecylsulfosuccinate ester. These surfactants may be used in combination with any of the surfactants mentioned previously which have a surface tension of 45 dyne/cm or more at a critical micelle concentration. The surfactant is used in such an amount that the solid content is 0.0001 to 10 parts, preferably from 0.005 to 0.5 part, by weight for 100 parts by weight of the solid content of the microcapsule.

The primary components of the microcapsule coating solution are microcapsules, binder and protective agent. The solid content of the binder must be 20 to 50 parts by weight for 100 parts by weight of the solid content of the microcapsules. The protective agent is used in such an amount that its solid content is 20 to 150 parts, preferably 40 to 100 parts, by weight for 100 parts by weight of the solid content of the microcapsules (this amount may slightly vary with the specific type of the agent).

Suitable examples of the binder used in the present invention are latices such as styrene/butadiene rubber latex, styrene/butadiene latex, acrylonitrile latex, and styrene/maleic anhydride copolymer latex; proteins such as gelatin, gum arabic, albumin and casein; water-soluble natural polymeric compounds such as cellulose (e.g., carboxymethyl cellulose, hydroxyethyl cellulose, etc.) and saccharose (e.g., agar, sodium alginate, starch, carboxymethyl starch, etc.); water-soluble synthetic polymeric compounds such as polyvinyl alcohol, polyvinyl pyrrolidone, polyacrylic acid and polyacrylamide. Among these binders, carboxymethyl cellulose, starch and polyvinyl alcohol are preferred. These polymeric compounds used as the binder generally have a molecular weight of from about 1,000 to 10,000,000, more advantageously from 10,000 to 5,000,000. For ease of handling, a binder having a viscosity of 500 centipoises (cPs) or less in aqueous solution for a solid content of 10% and at 25° C. is preferred. Examples of such binder are a styrene/butadiene rubber latex, styrene/butadiene latex, acrylonitrile latex, styrene/maleic anhydride copolymer latex, carboxymethyl cellulose, starch, polyvinyl alcohol and polyacrylic acid.

The protective agent used in the present invention is a particulate or fibrous material that is solid at ordinary temperatures. Specific examples are starch particles (as described in British Pat. No. 1,232,347), fine polymer particles (as described in U.S. Pat. No. 3,652,736), microcapsule particles containing no color former (as described in British Pat. No. 1,235,991), inorganic particles such as those of talc, kaolin, bentonite, pyrophyllite, zinc oxide, titanium oxide and alumina, and fine cellulose particles (as described in U.S. Pat. No. 3,625,736). The particulate protective agent generally has a volume average size of from 3 to 50 microns, preferably from 5 to 40 microns. It is effective for the purpose of the present invention that these particles are larger than the color former-containing microcapsules. The fibrous protective agent is generally from 50 to 600 microns, preferably from 100 to 400 microns, long. The above mentioned protective agents are those of the type which is directly added to the coating solution primarily made of microcapsules, and if a separate protective layer is formed on a coating primarily made of the microcapsules, the binder described above is usually employed. It is also possible to add the protective agent in the coating solution primarily made of microcapsules while simultaneously forming a separate protective layer.

According to the present invention, the coating solution primarily made of microcapsules is applied to the base in a dry weight of 2 g/m$^2$ or more, preferably 3.5 to 6 g/m$^2$ or more. The color former is used in an amount of from about 0.03 to 0.5 g/m$^2$. While there is no limitation on the size of the microcapsules, the preferred size is from 3 to 20 microns.

The color former to be microencapsulated is generally a compound which is substantially colorless and has a nucleus such as lactone, lactam, sultone, spiropyran, ester and amide and which, upon contact with a color developer, have these nuclei opened or cleaved. Specific examples are triaryl methane compounds, diphenyl methane compounds, xanthene compounds, thiazine compounds and spiropyran compounds. More specific examples are crystal violet lactone, benzoyl leucomethylene blue, malachite green lactone, rhodamine B lactam, 1,3,3-trimethyl-6'-ethyl-8'-butoxyindolinobenzospiropyran. These color formers are usually employed as a combination of quick release type and slow release type. These color formers are encapsulated by dissolving them in a solvent selected from among those which dissolve at least 5 wt% of the color former, particularly at least about 10 wt% of crystal violet lactone. The indicated solubility is that of one or more color formers at 23° C., and it is particularly preferred that the color formers do not precipitate out when left for about 3 days at 23° C. Specific examples are aliphatic and aromatic compounds such as chlorinated paraffin (having a chlorination degree of about 15 to 60), alkyl or aralkylbenzene or naphthalene (wherein the alkyl group has not more than about 5 carbon atoms), such as triphenylmethane, diphenyltrimethane, xylyl phenylethane, benzylxylene, α-methylbenzyltoluene, diisopropylnaphthalene, isobutylbiphenyl, tetrahydronaphthalene, hydrogenated terphenyl, di-α-methylbenzyl, xylene, tert-butyl-diphenyl ether, hydrogenated styrene dimer, edible oils and cootonseed oil. These solvents may be used either alone or in combination. They can also be used in combination with not more than about 20 wt% of a poor solvent for the color former, for example, low-boiling paraffin or alkylbenzene, and this is effective for providing an intermediate leaf that has good printability with reduced fog. Furthermore, the solvents may be mixed with an antioxidant and an agent to increase the color forming speed.

Reference can be had to any prior art publication for the additives and antioxidants to be used in applying the microcapsule solution on a base and the method for applying it. Examples are U.S. Pat. Nos. 2,711,375; 3,625,736; 3,836,383 and 3,846,331, British Pat. No. 1,232,347, and Japanese Patent Application (OPI) Nos. 44012/75, 50112/75, 127718/75, 30615/75. The drying temperature is preferably not more than about 180° C. and not less than 100° C. After drying, the web is preferably wound at a tension between about 50 and 250 kg. A greater tension will rupture the capsules and often causes unevenness in color.

Examples of the color developer are organic or inorganic acids such as clay minerals (e.g., acid clay, bentonite and kaolin), and organic acids or salts thereof (e.g., isopropenylphenol dimer, novolak, metal-treated novolak, 3,5-di-tert-butylsalicylic acid and zinc di-α-methylbenzylsalicylate salt). The organic acids include organic compounds having one or more acidic groups such as a carboxyl group, thiocarboxyl group, phenolic hydroxy group, mercapto group and sulfo group, or salts (particularly polyvalent metal salts) thereof. These organic compounds may be a polymer of materials such as acids derived from phenol, butylphenol, octylphenol, phenylphenol, isopropenylphenol dimer, etc., or novolak resins or metal salts thereof; acids such as salicylic acid, hydroxynaphthoic acid, tert-butylsalicylic acid, di-tert-butylsalicylic acid, tert-octylsalicylic acid, laurylsalicylic acid, dicyclohexylsalicylic acid, dibenzylsalicylic acid, di-α-methylbenzylsalicylic acid, di-α-dimethylbenzylsalicylic acid, anthranilic acid, tert-octyl-α-methylbenzylsalicylic acid, α-dimethylbenzyl-tert-octylsalicylic acid, α-methylbenzyloxynaphthoic acid and thiosalicylic acid, or metal salts thereof. A polyvalent metal is preferred as the metal to form salts with these acids, and examples of such metals include magnesium, calcium, zinc, aluminum and tin, and zinc and aluminum are particularly preferred. These metals may be used in the form of a metal salt from the beginning, or they may be in such a form that a metal salt is formed after a color developer coating is formed and dried. For forming a color developer coating, 10 parts by weight of the color developer (i.e., the above mentioned organic acid derivatives or polyvalent metal salts thereof) may be used in combination with about 1 to 300 parts by weight of metal compounds such as oxide, hydroxide, carbonate salt, acetate salt and phosphate salt of a polyvalent metal such as zinc, aluminum, barium, calcium or arsenic, or talc and clay, and this is effective in making the color developer exhibit its ability for an extended period (making the color developer remain stable over an extended period), although these additives have no ability to develop a color. The color developer and these optional components are dissolved or dispersed in an organic solvent or water, and the resulting solution or dispersion is applied onto a paper base. There is no limit on the upper limit of the amount of the color developer coating to be formed since this is determined by the capabilities of the pressure-sensitive recording paper desired and the cost of manufacturing it. When an organic acid is used as the color developer, the coating weight is generally between about 0.2 and 2 g/m$^2$, preferably between 0.25 and 1.3 g/m$^2$. A better result is obtained when this amount of organic acid is used together with about 0.25 to 10 g/m$^2$, preferably from 0.5 to 3 g/m$^2$ of zinc oxide. A color developer-coated paper having good printability is obtained when about 1.0 to 6 g/m$^2$ of a pigment such as a basic white pigment or white clay is also used. If the color developer is an inorganic solid acid, the coating weight is generally between 2 and 6 g, preferably between 3 and 5 g/m$^2$. The coating solution or dispersion may optionally contain a latex, water-soluble polymer such as carboxyl-modified styrene/butadiene copolymer, butadiene/butyl acrylate/styrene/maleic acid copolymer, vinyl acetate/styrene/methyl methacrylate copolymer or isoprene/maleic acid/acrylonitrile copolymer, petroleum resin, oxidized starch, polyvinyl alcohol or methyl cellulose. The coating solution or dispersion may also contain a dispersant or stabilizer as required, and it is applied to a paper base by any of the methods described in the previously mentioned patents, for example, by dip coating, air knife coating, blade coating, roller bead coating, curtain coating and gravure coating (see, for example, Japanese Patent Publication No. 35330/74, British Pat. Nos. 1,339,082; 1,176,469, U.S. Pat. Nos. 3,186,851 and 3,472,674). For the purpose of the present invention, the color developer coating is desirably smoothed and to do so the paper base with a color developer coating is preferably calendered before drying.

The present invention is now described in greater detail by reference to the following examples and comparative examples which are given here for illustrative purposes only and are by no means intended to limit its scope. In the examples and comparative examples, all parts are by weight.

(1) Preparation of Color Developer-coated Paper A

A dispersion with a solid content of 25 wt% consisting of 90 parts of talc, 1.0 part of naphthalenesulfonic acid/formalin condensate, 12 parts of zinc oxide, 9.5 parts of zinc 3,5-di-α-methylbenzylsalicylate, 3 parts of oxidized starch, 5.5 parts of polyvinyl alcohol, and 9 parts of carboxyl-modified styrene/butadiene latex was prepared with an attritor. The dispersion was applied to one surface of a paper base 1.8 m wide having a basis weight of 40 g/m$^2$ and a gas permeability of 60 seconds until the coating weight of zinc di-α-methylbenzylsalicylate was 0.36 g/m$^2$. The dispersion particles had a volume average size of 5μ.

(2) Preparation of Color Developer-coated Paper B

A hundred parts of acidic clay was dispersed in 400 parts of a 0.5% aqueous solution of sodium hydroxide. To the dispersion, 20 parts of a styrene/butadiene copolymer latex on a solid basis and 40 parts of a 100 wt% aqueous starch solution were added, and the mixture was stirred thoroughly to provide a color developer coating solution. The solution was applied to one surface of a paper base 1.8 m wide having a basis weight of 40 g/m$^2$ and a gas permeability of 60 seconds until the coating weight was 5.0 g/m$^2$ on a solid basis.

(3) Preparation of Microcapsule Solution A

Microcapsules each containing a color former were prepared according to U.S. Pat. No. 2,800,457. A mixture of 10 parts of acid-treated pigskin gelatin and 10 parts of gum arabic was dissolved in 400 parts of water at 40° C. To the solution, 0.2 part of sulfonated oil was added as an emulsifier and then 40 parts of a color former oil was dispersed. The color former oil was a 2% solution of crystal violet lactone in cyanopropylnaphthalene. When the average size of the oil globules became 5 microns, the dispersion was stopped, and water (40° C.) was added to make 900 parts of the emulsion which was further stirred. Then, 10% of acetic acid was added to adjust the pH of the emulsion to be 4.0 to 4.2 for initiating coacervation. The stirring was continued and 20 minutes later, the emulsion was cooled with ice water to gel the coacervate film formed around the oil globules. When the temperature of the emulsion became 20° C., 37% formalin was added. When the temperature was decreased to 10° C., 15% aqueous caustic soda was added to adjust the pH to 9. The emulsion was heated for 20 more minutes under agitation until the temperature was 50° C. The resulting emulsion was referred to as microcapsule solution A.

(4) Preparation of Microcapsule Solution B

One part of crystal violet lactone was dissolved in 22 parts of diisopropylnaphthalene. To the solution, 3 parts of an adduct of tolylene diisocyanate and trimethylolpropane and 0.1 part of an adduct of ethylenediamine and propylene oxide were added. The solution was put into a solution of 2.6 parts of polyvinyl alcohol in 29 parts of water at 20° C., and the resulting emulsion was mixed with 65 parts of water under stirring with heating. When the temperature was elevated to 70° C., the emulsion was further stirred for one hour to make a microcapsule solution B. This solution differed from the solution A in that it contained 2.6 parts of polyvinyl alcohol as a binder.

(5) Preparation of Microcapsule Solution C

Five parts of a partial sodium salt of poly(vinylbenzenesulfonic acid) (VERSA TL 500 of National Starch K.K., av. m.w. 500,000) was dissolved in 95 parts of hot water (80° C.) in about 30 minutes under stirring. The solution was then cooled and had a pH of 2 to 3. A 20 wt% aqueous solution of sodium hydroxide was added to the solution to increase its pH to 4.0. A hydrophobic solution was prepared by dissolving 4 parts of crystal violet lactone (CVL) in 100 parts of KMC-113 (an alkylnaphthalene of Kureha Chemical Industry Co., Ltd., mainly comprising diisopropylnaphthalene) under heating. The resulting hydrophobic solution was dispersed in 100 parts of the previously prepared 5% solution of partial sodium salt of poly(vinylbenzenesulfonic acid) to form an emulsion having particles of an average size of 4.5μ. A mixture of 6 parts of melamine, 11 parts of 37 wt% aqueous solution of formaldehyde and 83 parts of water was heated under stirring for 30 minutes to form a transparent aqueous solution which was a mixture of melamine, formaldehyde and an initial melamine/formaldehyde condensate. The resulting solution had a pH of 6 to 8. The aqueous solution which was a mixture of melamine, formaldehyde and initial melamine/formaldehyde condensate is hereunder referred to as an initial condensate solution. The initial condensate solution thus-prepared was mixed with the previously prepared emulsion under stirring while 20 wt% aqueous acetic acid was added to adjust the pH of the mixture to 6.0. The temperature of the mixture was elevated to 65° C., stirred for 60 more minutes, mixed with 1 N hydrochloric acid to adjust the pH of the system to 4.0, and further mixed with 30 g of a 40 wt% aqueous solution of urea. The system was further stirred at 65° C. for 40 minutes, and then, its pH was adjusted to 9.0 with 20 wt% aqueous sodium hydroxide. The so-prepared solution was referred to as microcapsule solution C.

The microcapsule coating solutions prepared in the examples and comparative examples contained 75 parts (based on 100 parts of the solid content of the microcapsules) of starch particles having a volume average size of 12μ as a protective agent.

EXAMPLE 1

After adding a protective agent to the microcapsule solution A, the solution was blended with a 1:1 mixture of polyvinyl alcohol and oxidized starch that was added as a binder in 30 parts with respect to 100 parts of the solid content of the microcapsules. As a surfactant, di-2-ethylhexylsulfosuccinate ester was added in 0.03 part with respect to 100 parts of the solid content of the microcapsules, to thereby prepare a microcapsule coating solution. The solution was then applied onto the uncoated surface of the color developer-coated paper A at a speed of 500 m/min to give a dry coating weight of 5.0 g/m$^2$. The web could be wound up without causing roll wrinkles and the sample obtained could form a desired color without fog. It had a gas permeability of 700 seconds. The sample was subjected to a heat resistance test wherein it was stored at 100° C. for 10 hours and the microcapsules were ruptured to form a color. In the test, a slight decrease in the color density was observed.

COMPARATIVE EXAMPLE 1

After adding a protective agent to the microcapsule coating A, the solution was blended with a 1:1 mixture of polyvinyl alcohol and oxidized starch that was added as a binder in 30 parts with respect to 100 parts of the solid content of the microcapsules, to thereby form a microcapsule coating solution. The solution was applied to the uncoated surface of the color developer-coated paper A at a speed of 500 m/min to give a dry coating weight of 5.0 g/m$^2$. When the web was wound up, a roll having wrinkles similar to the twisted pattern of a rope resulted. The sample obtained had a gas permeability of 5,000 seconds. No reduction in color density occurred in the subsequent heat resistance test.

EXAMPLE 2

A microcapsule coating solution prepared as in Example 1 was applied to the uncoated surface of the color developer-coated paper B at a speed of 500 m/min to give a dry coating weight of 5.0 g/m$^2$. The web could be wound up without causing roll wrinkles and the sample obtained could form a desired color without fog. The sample had a gas permeability of 500 seconds. A slight reduction in color density occurred in the subsequent heat resistance test.

COMPARATIVE EXAMPLE 2

A microcapsule coating solution prepared as in Comparative Example 1 was applied to the uncoated surface of the color developer-coated paper B at a speed of 500 m/min to give a dry coating weight of 5.0 g/m$^2$. When the web was wound up, a roll having wrinkles similar to the twisted pattern of a rope resulted. The sample had a gas permeability of 3,500 seconds. No reduction in color density occurred in the subsequent heat resistance test.

EXAMPLE 3

A microcapsule coating solution was prepared as in Example 1 except that the microcapsule solution A was replaced by the microcapsule solution B. The coating solution was applied to the uncoated surface of the color developer-coated paper A at a speed of 500 m/min to give a dry coating weight of 5.0 g/m$^2$. The web could be wound up without forming roll wrinkles and the sample obtained could form a desired color without fog. The sample had a gas permeability of 500 seconds. No reduction in color density occurred in the subsequent heat resistance test.

COMPARATIVE EXAMPLE 3

A microcapsule coating solution was prepared as in Comparative Example 1 except that the microcapsule solution A was replaced by the microcapsule solution B. The coating solution was applied to the uncoated surface of the color developer-coated paper A at a speed of 500 m/min to give a dry coating weight of 5.0 g/m$^2$. When the web was wound up, a roll having wrinkles similar to the twisted pattern of a rope was obtained. The sample had a gas permeability of 4,000 seconds. No reduction in color density occurred in the subsequent heat resistance test.

EXAMPLE 4

A microcapsule coating solution prepared as in Example 3 was applied to the uncoated surface of the color developer-coated paper B at a speed of 500 m/min to give a dry coating weight of 5.0 g/m$^2$. The web could be wound up without forming roll wrinkles and the sample obtained could form a desired color without fog. The sample had a gas permeability of 400 seconds. No reduction in color density occurred in the subsequent heat resistance test.

COMPARATIVE EXAMPLE 4

A microcapsule coating solution prepared as in Comparative Example 3 was applied to the uncoated surface of the color developer-coated paper B at a speed of 500 m/min to give a dry coating weight of 5.0 g/m$^2$. When the web was wound up, a roll having wrinkles similar to the twisted pattern of a rope was formed. The sample had a gas permeability of 3,000 seconds. No reduction in color density occurred in the subsequent heat resistance test.

EXAMPLE 5

A microcapsule coating solution was prepared as in Example 1 except that the microcapsule solution A was replaced by the microcapsule solution C. The coating solution was applied to the uncoated surface of the color developer-coated paper A at a speed of 500 m/min to give a dry coating weight of 5.0 g/m$^2$. The web could be wound up without forming roll wrinkles, and the sample obtained could form a desired color without fog. The sample had a gas permeability of 350 seconds. No reduction in color density occurred in the subsequent heat resistance test.

COMPARATIVE EXAMPLE 5

A microcapsule coating solution was prepared as in Comparative Example 1 except that the microcapsule solution A was replaced by the microcapsule solution C. The coating solution was applied to the uncoated surface of the color developer-coated paper A at a speed of 500 m/min to give a dry coating weight of 5.0 g/m$^2$. When the web was wound up, a roll having wrinkles similar to the twisted pattern of a rope was formed. The sample had a gas permeability of 3,000 seconds. No reduction in color density occurred in the subsequent heat resistance test.

EXAMPLE 6

A microcapsule coating solution as prepared in Example 5 was applied to the uncoated surface of the color developer-coated paper B at a speed of 500 m/min to give a dry coating weight of 5.0 g/m$^2$. The web could be wound up without forming roll wrinkles, and the sample obtained had a gas permeability of 300 seconds. No reduction in color density occurred in the subsequent heat resistance test.

COMPARATIVE EXAMPLE 6

A microcapsule coating solution prepared as in Comparative Example 5 was applied to the uncoated surface of the color developer-coated paper B at a speed of 500 m/min to give a dry coating weight of 5.0 g/m$^2$. When the web was wound up, a roll having wrinkles similar to the twisted pattern of a rope was formed. The sample had a gas permeability of 2300 seconds. No reduction in color density occurred in the subsequent heat resistance test.

COMPARATIVE EXAMPLE 7

To the microcapsule solution C, a protective agent was added, and a 1:1 mixture of polyvinyl alcohol and oxidized starch was added as a binder in 10 parts with respect to 100 parts of the solid content of the microcapsules, to thereby form a microcapsule coating solution. The solution was applied onto the uncoated surface of the color developer-coated paper B at a speed of 500 m/min to give a dry coating weight of 5.0 g/m$^2$. The web could be wound up without forming roll wrinkles, but the sample obtained formed a color with fog. The sample had a gas permeability of 700 seconds. No reduction in color density occurred in the subsequent heat resistance test.

COMPARATIVE EXAMPLE 8

To the microcapsule solution C, a protective agent was added, and a 1:1 mixture of polyvinyl alcohol and oxidized starch was added as a binder in 60 parts with respect to 100 parts of the solid content of the microcapsules. As a surfactant, di-2-ethylhexylsulfosuccinate ester was added in 0.03 part with respect to 100 parts of the solid content of the microcapsules, to thereby form a microcapsule coating solution. The coating solution was applied to the uncoated surface of the color developer-coated paper B at a speed of 500 m/min to give a dry coating weight of 5.0 g/m$^2$. The web could be wound up without forming roll wrinkles, and the sample obtained formed a desired color without fog. Seven sheets of the sample were placed respectively under plain sheets, set on a typewriter (olympia SGE/50) and struck with a light key stroke. The 7th copy was illegible. The sample had a gas permeability of 900 seconds and no reduction in color density occurred in the subsequent heat resistance test.

COMPARATIVE EXAMPLE 9

To the microcapsule solution C, a protective agent was added, and a 1:1 mixture of polyvinyl alcohol and oxidized starch was added as a binder in 30 parts with respect to 100 parts of the solid content of the microcapsules. As a surfactant, sodium dodecylbenzenesulfonate was added in 0.03 part with respect to 100 parts of the solid content of the microcapsules, to thereby form a microcapsule coating solution. The coating solution was applied to the uncoated surface of the color developer-coated paper B at a speed of 500 m/min to give a dry coating weight of 5.0 g/m$^2$. When the web was wound up, roll wrinkles resulted. The sample had a gas permeability of 1,800 seconds, and no reduction in color density occurred in the subsequent heat resistance test.

EXAMPLE 7

To the microcapsule solution B, a protective agent was added, and a 1:1 mixture of polyvinyl alcohol and oxidized starch was added as a binder in 30 parts with respect to 100 parts of the solid content of the microcapsules. As a surfactant, a dihexylsulfosuccinate ester was added in 0.03 part with respect to 100 parts of the solid content of the microcapsules. The resulting coating solution was applied to the uncoated surface of the color developer-coated paper A at a speed of 700 m/min to give a dry coating weight of 5.0 g/m$^2$. The web could be wound up without forming roll wrinkles, and the sample obtained could form a color without fog. The sample had a gas permeability of 350 seconds. No reduction in color density occurred in the subsequent heat resistance test.

EXAMPLE 8

To the microcapsule solution B, a protective agent was added, and a 1:1 mixture of polyvinyl alcohol and oxidized starch was added as a binder in 30 parts with respect to 100 parts of the solid content of the microcapsules. As a surfactant, a tetramethyl-tetradecasulfosuccinate ester was added in 0.03 part with respect to 100 parts of the solid content of the microcapsules, to thereby form a microcapsule coating solution. The coating solution thus-obtained was applied onto the uncoated surface of the color developer-coated paper A at a speed of 700 m/min to give a dry coating weight of 5.0 g/m$^2$. The web could be wound up without forming roll wrinkles, and the sample could form a desired color without fog. The sample had a gas permeability of 400 seconds, and no reduction in color density was observed in the subsequent heat resistance test.

As shown by the foregoing examples and comparative examples, the microcapsule sheet of the present invention has high color density with little fog and is adapted to high-speed production.

For quick reference, the results of the examples and comparative examples are listed in Table 1 below.

TABLE 1

| Run No. | Color Developer-Coated Paper | Capsule Solution | Surfactant | Binder (in parts) per 100 Parts of the Solid Content of Microcapsules | Roll Wrinkles | Gas Permeability (sec) | Heat Resistance Test | Fog in Color Formation | Color Density after Typewriter Key Impact |
|---|---|---|---|---|---|---|---|---|---|
| Example 1 | A | A | A | 30 | o | 700 | Δ | o | o |
| Comp.Ex.1 | A | A | — | 30 | x | 5,000 | o | o | o |
| Example 2 | B | A | A | 30 | o | 500 | Δ | o | o |
| Comp.Ex.2 | B | A | — | 30 | x | 3,500 | o | o | o |
| Example 3 | A | B | A | 40 | o | 500 | o | o | o |
| Comp.Ex.3 | A | B | — | 40 | x | 4,000 | o | o | o |
| Example 4 | B | B | A | 40 | o | 400 | o | o | o |
| Comp.Ex.4 | B | B | — | 40 | x | 3,000 | o | o | o |
| Example 5 | A | C | A | 34 | o | 350 | o | o | o |
| Comp.Ex.5 | A | C | — | 34 | x | 3,000 | o | o | o |
| Example 6 | B | C | A | 34 | o | 300 | o | o | o |
| Comp.Ex.6 | B | C | — | 34 | x | 2,300 | o | o | o |
| Comp.Ex.7 | B | C | — | 14 | o | 700 | o | x | o |
| Comp.Ex.8 | B | C | A | 64 | o | 900 | o | o | x |
| Comp.Ex.9 | B | C | B | 34 | x | 1,800 | o | o | o |
| Example 7 | A | B | C | 30 | o | 350 | o | o | o |

TABLE 1-continued

| Run No. | Color Developer-Coated Paper | Capsule Solution | Surfactant | Binder (in parts) per 100 Parts of the Solid Content of Microcapsules | Roll Wrinkles | Gas Permeability (sec) | Heat Resistance Test | Fog in Color Formation | Color Density after Typewriter Key Impact |
|---|---|---|---|---|---|---|---|---|---|
| Example 8 | A | B | D | 30 | o | 400 | o | o | o |

In Table 1, the symbols A, B, C and D in the column "surfactant" respectively stand for a di-2-ethylhexylsulfosuccinate ester, sodium dodecylbenzenesulfonate, dihexylsulfosuccinate ester and tetramethyltetradecasulfosuccinate ester. The signs o, Δ, and × respectively mean that the sample was good, slightly poor and poor in the indicated properties.

While the invention has been described in detail and with reference to specific embodiments thereof, it will be apparent to one skilled in the art that various changes and modifications can be made therein without departing from the spirit and scope thereof.

What is claimed is:

1. A wrinkle-free pressure-sensitive microcapsule recording paper, prepared by a process comprising the steps of providing a support base paper;

coating one surface of said support base paper with a color developer-coating solution wherein said color developer-coating solution is comprised of a color developer dissolved or dispersed in a solvent selected from the group consisting or organic solvents and water; and coating the other surface of said support base paper with a microcapsule coating solution, wherein said microcapsule coating solution is comprised of microcapsules, a binder, a surfactant, and a protective agent, wherein said microcapsules contain an electron-donating color former, said binder has a solid content of 20 to 50 parts by weight per 100 parts by weight of the solid content of said microcapsules, wherein said surfactant is used in an amount such that the solid content is 0.0001 to 10 parts per 100 parts by weight of said solid content of said microcapsules and has a hydrophobic atomic group of the formula:

$$\begin{array}{l} R_1-OOC-CH- \\ \qquad\qquad\quad | \\ R_2-OOC-CH_2 \end{array}$$

wherein $R_1$ and $R_2$ are each an aliphatic hydrocarbon having 2 to 20 carbon atoms or aromatic hydrocarbon having 6 to 20 carbon atoms.

2. A pressure-sensitive microcapsule recording paper, formed by the steps as claimed within claim 1, wherein said surfactant is used in an amount such that said solid content is 0.005 to 0.5 part by weight per 100 parts by weight of said solid content of said microcapsules.

3. A pressure-sensitive microcapsule recording paper, formed by the steps as claimed within claim 1, wherein said protective agent is used in an amount such that the solid content of said protective agent is 20 to 150 parts by weight per 100 parts by weight of said solid content of said microcapsules.

4. A pressure-sensitive microcapsule recording paper, formed by the steps as claimed within claim 3, wherein said protective agent is used in an amount such that said solid content is 40 to 100 parts by weight per 100 parts by weight of said solid content of said microcapsules.

5. A pressure-sensitive microcapsule recording paper, formed by the steps as claimed within claim 1, wherein said base paper provided has a gas permeability of 90 seconds or less.

6. A pressure-sensitive microcapsule recording paper, formed by the steps as claimed within claim 1, wherein said binder has a molecular weight of from 1,000 to 10,000,000.

7. A pressure-sensitive microcapsule recording paper, formed by the steps as claimed within claim 6, wherein said binder has a molecular weight of from 10,000 to 5,000,000.

8. A pressure-sensitive microcapsule recording paper, formed by the steps as claimed within claim 1, wherein said protective agent is a particulate protective agent having a volume average size within the range of 3 to 50 microns.

9. A pressure-sensitive microcapsule recording paper, formed by the steps as claimed within claim 8, wherein said volume average size of said particulate protective agent is within the range of 5 to 40 microns.

10. A pressure-sensitive microcapsule recording paper, formed by the steps as claimed within claim 1, wherein said protective agent is a fibrous protective agent having a length within the range of 50 to 600 microns.

11. A pressure-sensitive microcapsule recording paper, formed by the steps as claimed within claim 10, wherein said fibrous protective agent has a length within the range of 100 to 400 microns.

12. A pressure-sensitive microcapsule recording paper, formed by the steps as claimed within claim 1, wherein said coating solution is applied to said base paper in a dry weight of 2 $g/m^2$ or more.

13. A pressure-sensitive microcapsule recording paper, formed by the steps as claimed within claim 2, wherein said coating solution is applied to said base paper in a dry weight within the range of 3.5 to 6 $g/m^2$.

14. A pressure-sensitive microcapsule recording paper, formed by the steps as claimed within claim 1, wherein said color former is contained in an amount within the range of 0.03 to 0.5 $g/m^2$.

15. A pressure-sensitive microcapsule recording paper, formed by the steps as claimed within claim 1, wherein said microcapsules have a size within the range of 3 to 20 microns.

* * * * *